United States Patent [19]

Feichtiger et al.

[11] Patent Number: 4,815,306

[45] Date of Patent: Mar. 28, 1989

[54] CYLINDER LOCK/ACTUATOR SUBASSEMBLY

[75] Inventors: Dieter Feichtiger, Aidlingen; Franz Waschitschek, Sindelfingen; Götz Mötting; Walter Münsinger, both of Böblingen; Hans Deischl, Jettingen, all of Fed. Rep. of Germany

[73] Assignee: Daimler-Benz Aktiengesellschaft, Fed. Rep. of Germany

[21] Appl. No.: 74,860

[22] Filed: Jul. 17, 1987

[30] Foreign Application Priority Data

Jul. 24, 1986 [DE] Fed. Rep. of Germany ..... 3625068

[51] Int. Cl.[4] ..... E05B 25/12

[52] U.S. Cl. ..... 70/240; 70/256

[58] Field of Search ..... 70/256, 240, 241, 134, 70/129, 257, 135, 139, 141, 144

[56] References Cited

U.S. PATENT DOCUMENTS

| | | | |
|---|---|---|---|
| 3,016,968 | 1/1962 | Lenz et al. . | |
| 3,062,033 | 11/1962 | Schmalfeldt | 70/256 |
| 3,572,068 | 3/1971 | Carlson | 70/241 |
| 4,312,197 | 1/1982 | Carrion | 70/240 |
| 4,652,027 | 3/1987 | Quantz | 70/241 |
| 4,667,990 | 5/1987 | Quantz | 70/241 |

FOREIGN PATENT DOCUMENTS

| | | | |
|---|---|---|---|
| 8304354 | 2/1983 | Fed. Rep. of Germany . | |
| 3436318 | 4/1984 | Fed. Rep. of Germany . | |
| 1386558 | 3/1975 | United Kingdom | 70/256 |
| 2142078 | 1/1985 | United Kingdom . | |

*Primary Examiner*—Robert L. Wolfe

*Attorney, Agent, or Firm*—Barnes & Thornburg

[57] ABSTRACT

A preassemblable cylinder lock/actuator subassembly of a central locking system is designed so that, at the same time as the actuator is necessarily fastened to a lock carrier in the correct position, the actuating member of the actuator is coupled in a functionally reliable way to a lock operating lever.

15 Claims, 2 Drawing Sheets

CYLINDER LOCK/ACTUATOR SUBASSEMBLY

BACKGROUND AND SUMMARY OF THE INVENTION

The invention relates to a cylinder lock/actuator subassembly for locking and unlocking a motor vehicle door or tailgate Such subassemblies include a power assist device and manually operable key devices for operating the locking cylinder A subassembly of the relevant generic type is known from German Utility Model No. 83.04,354, wherein the cylinder lock and its (electromagnetic) actuator are attached to a common mounting plate The description of the German utility model does not deal with the method of fastening the individual parts of the door lock to the mounting plate, but it can be seen from the drawing of the German utility model that, when the locking cylinder is already fixed in place, at least one additional bearing point and the actuator housing have to be fastened, connected loosely only by the displaceable actuating member passing through both of them, separately on the mounting plate.

Since the actuating member has to be freely displaceable in the actuator and matches the movements of the locking cylinder with play via a lost-motion connection, correct assembly is possible only with a certain amount of skill despite the certainly advantageous common mounting plate. Incorrect assembly, for example such that the two limit stops of the lost-motion connection are not located on both sides of the locking cylinder, is not altogether prevented.

Moreover, when the locking control of the actuator is operated remotely, the door lock can remain unlocked without this being noticed, if its release lever happens to be in a position which prevents the lock bolt connected fixedly to the actuating member from coming into locking positive engagement with the release lever.

U.S. Pat. No. 3,016,968 makes known a remote-controlled trunk lid unlocking device, in which a low-pressure actuator is connected to a release lever of the trunk lid cylinder lock via a pull-rod having lost motion. The cylinder lock and low-pressure actuator are fastened to the motor vehicle body independently of one another. A pivot point is provided as a mounting for the low-pressure actuator and simplifies the adjusting work which is always necessary.

The low-pressure actuator is combined with an adapter which has to be inserted between the locking cylinder and the actual lock.

When the subassembly is assembled, three different parts, namely the locking cylinder, actuator/adapter and lock, consequently have to be brought into the correct relative position and each fastened in the vehicle.

United Kingdom Patent Application No. 2,142,078 describes a subassembly consisting of a motor vehicle door lock and an electromotive actuator. The actuator is the sole means of unlocking and locking the lock towards the outside, since the latter does not have a locking cylinder for actuating it by a key, and is therefore incorporated very far into the lock. Thus, the electric motor is accommodated in its own housing and inserted in it between two lock wall plates. Its housing has a cylindrical extension, on the outer periphery of which are bearing points for two lock operating levers. Located within the cylindrical housing extension is the output shaft of the electric motor. Attached to this, likewise in the interior of the housing extension, is the actuating member, a driver, which via a helical drive formation, as a result of rotation of the output shaft, is shifted axially to and from on the latter between two end positions. In one of the two end positions, the driver-type actuating member connects the two lock operating levers positively, so that the lock is unlocked and can be opened from outside.

In the opposite end position, the driver-type actuating member is engaged only with the inner lock operating lever inaccessible from outside, so that no force can be transmitted between the two levers and the lock is locked from the outside.

In this arrangement, the actuator is to be considered as an integral part of the lock itself and has to be built into the lock even before the final assembly of the latter.

It is true that German Published Unexamined Patent Application (DOS) No. 3,436,318 gives a suggestion that two lock housing parts, the first of which can also be called the lock carrier, can be joined by means of a plug-in connection during assembly.

The joint also has a specific (frictional) non-positive connection, but is nevertheless neither intended nor can be used for forming fixed points, since it does not necessarily ensure a specific fastening position between the two housing parts, but, with a degree of freedom of displacement being left, is provided merely as a guide for the compensation of tolerance, for example, instead of slots. The two housing parts always have to be fastened to body walls independently of one another, and ready assembly of the lock outside the vehicle is not possible.

Moreover, no actuator is provided in the last-mentioned publication.

An object of the invention is to design the components of a preassemblable cylinder lock/actuator subassembly of the relevant generic type, so that they can be preassembled with only a few manipulations, reliably in the correct position and so as to be functionally reliable.

According to the invention, the objects are achieved by providing separate actuator and locking cylinder subassemblies which are mountable to a lock carrier plate and which include mounting guide surfaces at an operating lever of the locking cylinder subassembly and at an actuating member of the actuator subassembly for assuring correct position of the parts when the actuator subassemblies are mounted at the carrier plate.

In preferred embodiments, the housing for the actuator assembly is mountable by a plug-in connection not requiring tools.

A great advantage of the subassembly arrangement according to the invention is that the actuator can be attached in the simplest possible way by means of appropriately designed fastening points to mounting means on the lock carrier, and the plug-in connections can be clipped together positively or designed as a press fit or as a combination with positive and non-positive connection, according to embodiments contemplated. It is also contemplated to have embodiments which use an adhesive bond to advantage, the same being preferably releasable in a simple way for repair or exchange purposes.

A screw connection between the actuator subassembly and lock carrier is especially advantageous, for example, for repair purposes in certain contemplated embodiments. In all the above-mentioned possibilities of connection, a definite relationship between the actuator housing and lock carrier as regards the assembly position can be ensured in a simple way by shaping the plug elements, for example, as a round pin and round eye, or a polygonal pin and polygonal eye, dimensions differing between pairs, and the like, or by means of the spatial arrangement on the actuator housing and lock carrier, according to the various preferred embodiments.

The actuating member of the actuator and the latch foot can also be coupled permanently to one another directly, and advantageously this coupling can also be made by pluggable coupling means, according to certain preferred embodiments. These can then be engaged at the same time as the connection between the actuator housing and lock carrier, without a special operation being required for this. As the result of a suitable design of the coupling means with funnel-shaped deflecting faces, the coupling between the actuating member and the latch foot necessarily assumes the correct position. For if these do not engage one another correctly, the actuator housing is also prevented from being fastened correctly to the lock carrier, because the actuating member runs up against a deflecting contour of the latch foot, and thus prevents the actuator housing from coming nearer to the lock carrier.

Other objects, advantages and novel features of the present invention will become apparent from the following detailed description of the invention when considered in conjunction with the accompanying drawings.

DETAILED DESCRIPTION OF THE DRAWINGS

Figure 1:
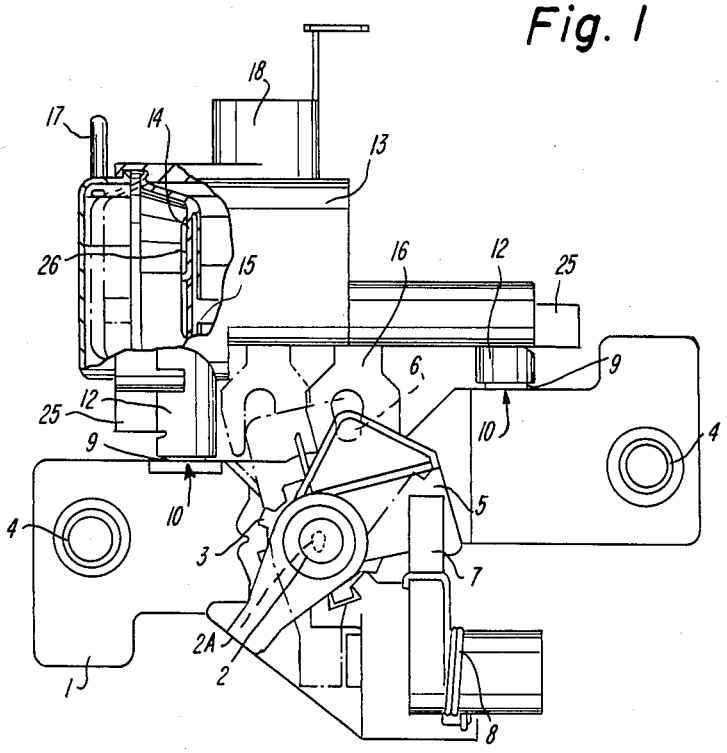
FIG. 1 is a schematic, part-sectional view of a preassembled locking, arrangement constructed in accordance with a preferred embodiment of the invention.

In FIG. 1, a key operable locking cylinder or pivot 2 is mounted in a lock carrier 1 so as to be longitudinally displaceable in a splined shaft profile 3. Bushing sleeves 4 are inserted into the lock carrier and serve for screwing it to a motor vehicle body wall. A latch foot 5 with an operating lever 6 is arranged at the visible end of pivot 2 facing away from the keyhole 2A depicted in dash lines. A detent pawl 7 with a restoring spring 8 is arranged pivotably on the lock carrier 1. Pawl 7 is engaged with the latch foot 5 in the position of the latter represented by unbroken lines. Thus, when the pivot 2 is now pressed in (out of the drawing plane), the latch foot 5 moves the detent pawl 7 counter to the restoring spring 8.

Figure 3:
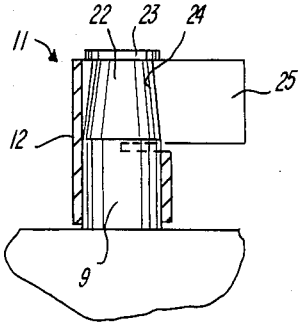
FIG. 3 an enlarged, partial view depicting an embodiment of a clippable plug-in connection between the actuator and lock carrier, again as a detail from FIG. 1.
Figure 4:
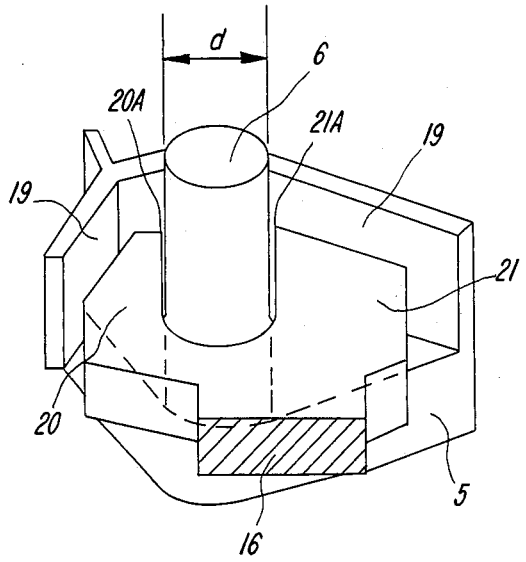
FIG. 4 is a perspective view of the embodiment of the plug-in coupling of FIG. 2.

Mounting means 9 are formed integrally on the lock carrier 1. These constitute fixed points 10 for a clip connection 11 (FIG. 3) between the lock carrier 1 and fastening points 12 on an actuator housing 13. In the actuator housing 13, a pneumatic diaphragm-piston actuating drive 14 with a piston rod 15 and with an actuating member 16 connected to the latter is arranged so as to be movable to and fro between two stable end Positions (represented by unbroken lines and by dot-and-dash lines). Overpressures and under pressures required for these stroke movements are fed to the actuating drive 14 via a pump connection 17.

During each stroke movement of the actuating drive 14 and of the actuating member 16 between their end positions, the latch foot 5 is taken up by the actuating member 16 via the operating lever 6, and in the position represented by broken lines it is disengaged from the detent pawl 7, that is to say it does not move the detent pawl 7 when the locking cylinder 2 is pressed in. The same pivoting movement can also be imparted to the latch foot 5 by turning a key in the locking cylinder 2 (from the rearside not shown), and in this case the operating lever 6 takes up the actuating member 16 and the actuating drive 14.

If the cylinder lock is intended to activate a central locking system, an electrical switch indicated by a socket 18 has to be provided in the actuator housing 13. This switch is likewise shifted into two end positions by means of the stroke movements of the actuating drive 14. So that the electrical switch can be operated by turning a key even when there is still overpressure or underpressure (immediately after a locking operation), an overrideable engaging connection between the actuating member 16 and the piston rod 15 is provided in the actuator housing 13 in a known way.

Likewise in a known way, the rubber diaphragm of the actuating drive 14 is designed geometrically in such a way that it has a pronounced snap effect which ensures that the actuating drive snaps reliably to and fro between the two end positions. Indeterminate intermediate positions are thus very substantially prevented. By means of spacer ribs 26 on the side of the diaphragm facing away from the piston rod, a possible surface impact of the diaphragm on the actuator bottom is damped.

Figure 2:
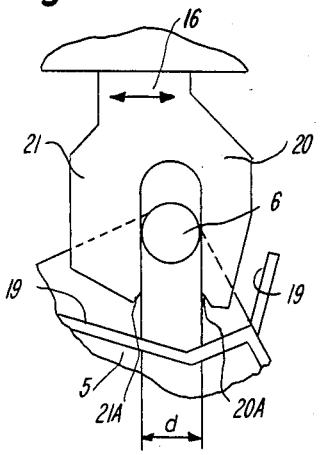
FIG. 2 is an enlarged, partial view depicting an embodiment of a plug-in coupling between the actuating member and the latch foot as a detail from FIG. 1.

FIG. 2 shows an inter-engageable coupling between the actuating member 16 and the operating lever 6 of the latch foot 5 as a detail from FIG. 1, rotated through 180°. The operating lever 6 is formed on the latch foot 5 integrally as a pin. It is surrounded by a funnel contour 19 which is likewise formed on the latch foot 5, and which opens towards the actuating member 16. The latter is designed as a fork with two legs 20 and 21, which engages around the circular operating lever 6. Its clear width corresponds to the diameter d of the operating lever 6 and guides the latter during the linear stroke movements of the actuating drive 14 which are in the direction indicated by arrows in the drawing. The fork throat between the two legs 20, 21 is relatively deep, so that the operating lever 6 executing a pivoting movement about the longitudinal axis of the locking cylinder 2 cannot slide out of the fork throat.

The broad wedge shape of the fork legs 20, 21, in interaction with the funnel contour 19 and the operating lever 6 of the latch 5 surrounded by the latter, ensures that the correct relative and coupling position between the actuating member 16 and the latch foot 5 is necessarily assumed when the subassembly is fitted together. Even in an approximately correct relative position the operating lever 6 is introduced into the fork throat by means of the sloping faces 20A, 21A. When in an incorrect relative position, at least one of the two fork legs 20, 21 runs up against the funnel contour 19 of the latch foot 5 and jams, for example, between the funnel contour 19 and the operating lever 6. This prevents the actuator housing 13 from coming nearer to the lock carrier 1, so that the clip connection 11, as shown in detail in FIG. 3, cannot engage.

The clip connection 11 is formed by two retaining bolts 9 formed integrally on the lock carrier 1 and by two mounting sleeves or eyes 12 of the actuator housing 13 which are arranged spatially offset in pairs on the lock carrier 1 and on the actuator housing 13 respectively, in such a way that it is possible to fit them together correctly only in a single position relative to one another.

Each retaining bolt 9 has a cylindrical and a conical length portion, the conical portion 22 tapering towards the free end of the retaining bolt 9 and at its end having a collar 23 of the same outside diameter as the cylindrical bolt portion.

Each mounting eye 12 has the same inside diameter as the retaining bolt 9 assigned to it, but a snap nose 24 projecting into the free cross-section. When the mounting eye 12 is pushed onto the retaining bolt 9, this snap nose 24 is first bent open elastically by the collar 23, but then drops behind the collar in the manner of a pawl and thus locks the mounting eye on the retaining bolt.

As already stated regarding FIG. 2, the clip connection 11 can engage only when the actuator housing 13 is not prevented from coming nearer to the lock carrier 1 because the actuating member 16 runs up against the contour 19 of the latch foot 5. The design of the clip connection 11 shown in FIG. 3 assists in ensuring a correct fitting of the subassembly according to the invention, since the elastically opened snap nose 24, before it drops in behind the collar 23, presses the actuator housing 13 away from the lock carrier 1 or from the retaining bolt 9 and thus tells the fitter that assembly is incorrect.

A tab 25 is provided so that the snap nose 24 can be lifted over and beyond the collar 23 by hand in order to break the clip connection.

Other forms of connections between the actuator and lock carrier on the one hand and between the actuating member and latch foot on the other hand can also be used, without departing from the main idea of the invention. Thus, for example, the actuating member itself cold be designed as a journal which is introduced, in the correct relative position in relation to the latch foot, into a fork-like receiving contour of the latter, and in principle this would result in a reversal of the coupling means in comparison with the exemplary embodiment described. In this case, plane or curved deflecting faces would have to be provided on the latch foot in addition to the receiving fork, so that, in this design too, the subassembly is prevented from being assembled incorrectly by mistake because the actuating member runs up against a contour of the latch foot when the relative position between the actuating member and the (fork-like) operating lever is incorrect.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Locking arrangement for selectively locking and unlocking a vehicle door or tailgate, comprising:

a cylinder lock assembly including a manual key actuable locking cylinder which is mounted for rotational movement and longitudinal movement;

detent pawl means movable between door locking and unlocking Positions;

latch foot means operably connected with the locking cylinder and detent pawl means for moving the detent pawl means toward its unlocking position in response to longitudinal movement of the locking cylinder when in an unlocking rotational position;

an actuator subassembly including a movable actuator engageable with the latch foot means and power assist means for moving the actuator between detent pawl means unlocking and locking Positions, said actuator including an actuating member engageable with an operating lever of the latch foot means;

lock carrier means; and mounting means for mounting the actuator subassembly and the cylinder lock subassembly to the lock carrier means, wherein said actuating member and said operating lever include interengageable mounting guide surface means for preventing mounting of the cylinder lock subassembly and the actuator subassembly to the lock carrier means when the actuating member and operating lever are not in a correct operating position with respect to one another.

2. A locking arrangement according to claim 1, wherein said mounting means includes mounting plug means at one of the lock carrier means and actuator subassembly and mounting sleeve means at the other of the lock carrier means and actuator subassembly, said mounting plug means and mounting sleeve means being positively interengageable to mount the actuator subassembly to the lock carrier means 3. A locking arrangement according to claim 2, wherein said mounting plug means and mounting sleeve means include respective pairs of mounting plugs and mounting sleeves 4. A locking arrangement according to claim 3, wherein said mounting plugs and mounting sleeves form respective plug-in connections which can be made manually without tools.

5. A locking arrangement according to claim 1, wherein said actuator subassembly includes an actuator housing, wherein said power assist means is a pneumatic diaphragm-piston actuating drive disposed in the actuator housing, and wherein the actuating member is guided out of the actuator housing laterally and perpendicularly to its movement stroke axis.

6. A locking arrangement according to claim 5, wherein said mounting means includes fastening points on the actuator housing arranged on the same side as that from which the actuating member is guided out.

7. A locking arrangement according to claim 5, wherein the fastening points of the actuator housing and the mounting means of the lock carrier are designed as elements of positive and/or non-positive plug-in connections fittable without a tool and having at least two fixed points.

8. A locking arrangement according to claim 7, wherein the mounting means on the lock carrier and correspondingly the fastening points on the actuator housing are arranged spatially offset, but with parallel connecting axes, so that incorrect assembly by mistake is prevented 9. A locking arrangement according to claim 5, wherein outside the actuator housing the actuating member is designed essentially as a fork, and wherein the operating lever is a pin-shaped operating lever of the latch foot which has a diameter corresponding to the clear width of the fork.

10. A locking arrangement according to claim 9, wherein mounting guide surfaces include a funnel contour on the latch foot near the operating lever, said funnel contour surrounding the operating lever and being open towards the actuating member with an opening dimension which is slightly greater than the outer dimension of the fork formed by the actuating member.

11. A locking arrangement according to claim 5, wherein the actuating member is designed as a protrusion extending outside the actuator housing, and wherein the latch foot, on the side facing the actuating member, has an outer contour formed as a funnel with the operating lever extending across with deflecting funnel faces adjoining the operating lever which projects at an angle from the funnel walls

12. A locking arrangement according to claim 7, wherein the respective matching pairs of fastening points and mounting means have different dimensions in pairs, so that incorrect assembly by mistake is prevented.

13. A locking arrangement according to claim 1, wherein the actuator subassembly includes a housing for the power assist means, and wherein the mounting means for the actuator subassembly includes fastening points on the actuator housing designed as insert eyes, and wherein the mounting means on the lock carrier are designed as set screws or stud bolts of corresponding diameter, so that the actuator housing can be screwed to the lock carrier by means of nuts.

14. A locking arrangement according to claim 1, wherein the cylinder lock subassembly is configured such that, when the key is withdrawn, the locking cylinder can assume a neutral position or a security position, and in the latter position of the locking cylinder the latch foot cannot be pivoted by means of the power assist means

15. A locking arrangement according to claim 1, wherein said lock carrier means is a common mounting plate which is fixedly attachable to vehicle fixed parts.

* * * * *